United States Patent [19]

Zegarski

[11] Patent Number: 5,069,982

[45] Date of Patent: Dec. 3, 1991

[54] MIXED PHOSPHOR X-RAY INTENSIFYING SCREENS WITH IMPROVED RESOLUTION

[75] Inventor: William J. Zegarski, Towanda, Pa.

[73] Assignee: E. I. Du Pont de Nemours and Company, Wilmington, Del.

[21] Appl. No.: 615,508

[22] Filed: Nov. 19, 1990

[51] Int. Cl.[5] ..... G03C 5/17; G21K 4/00

[52] U.S. Cl. ..... 428/690; 250/483.1; 252/301.4 H; 252/301.5

[58] Field of Search ..... 428/690; 250/483.1; 252/301.4, 301.5, 301.4 H, 301.4 F, 301.4 R

[56] References Cited

U.S. PATENT DOCUMENTS 4,387,141 6/1983 Patten ..... 428/690

*Primary Examiner*—James J. Seidleck
*Assistant Examiner*—Charles R. Nold

[57] ABSTRACT

An X-ray intensifying screen made from a mixture of yttrium tantalate and lanthanum oxyhalide phosphors is described. This screen, when used to expose a silver halide element, e.g., conventional grain or tabular grain element, will produce superior image resolution compared to similar screens made using single phosphors alone.

12 Claims, No Drawings

MIXED PHOSPHOR X-RAY INTENSIFYING SCREENS WITH IMPROVED RESOLUTION

FIELD OF THE INVENTION

This invention relates to X-ray intensifying screens and more particularly to X-ray intensifying screens having improved resolution.

BACKGROUND OF THE INVENTION

X-rays are conventionally used to examine and evaluate the interior of dense materials and are also used in the medical evaluation of humans. In order to record the images produced by these evaluations, it has been conventional to employ X-ray intensifying screens containing a suitable phosphor to convert the X-ray energy to a more useful UV-visible light. The light emitted by the phosphor will then expose a conventional silver halide element in contact with the screen and thus produce the desired record.

The X-ray screens are conventionally fabricated by using a suitable phosphor mixed in a slurry with a binder and coated on some sort of conventional support such as cardboard or polyester film, for example. The useful phosphors are usually prepared by mixing the starting materials together and firing the mixture at elevated temperatures in various atmospheres, e.g., nitrogen, hydrogen, etc. The phosphor is then washed to remove unreacted starting materials and slurried with a suitable binder as previously described. After coating, a protective topcoat or abrasion coat may be applied thereover in order to extend the usable life of the finished screen.

While there are many known materials that can luminesce under the influence of impinging X-ray energy, only a special few have those properties that are requisite for use as an X-ray intensifying screen. These include the well-known calcium tungstate phosphors, as well as the M′ monoclinic tantalates described by Brixner in U.S. Pat. No. 4,225,653. These tantalate phosphors are extremely efficient in converting X-ray energy to UV light and are now widely used. Also to be mentioned are the lanthanum and gadolinium oxyhalides similar to those described by Brines and Rabatin in U.S. Pat. No. 4,499,159.

Images produced by silver halide elements used with the aforementioned X-ray intensifying screen elements, must be sharp and clear especially when they are used to record X-ray evaluations of the human body. Speed is also an important factor since it is deleterious to expose the human body to overdoses of X-rays. Thus, there is a special need to maintain the high speed of X-ray intensifying screen elements to minimize radiation exposure while at the same time insuring that a quality image, free of noise, is produced.

The use of mixed phosphors is also known in the prior art. For example, Patten in U.S. Pat. No. 4,387,141 describes a mixed phosphor comprising calcium tungstate and the tantalates of the aforementioned Brixner patent to achieve improved speed and sharpness and low noise.

Since tabular grain silver halide elements are becoming more popular there is also a need to match the characteristics of these light-sensitive grains with the light output of various phosphors and still achieve good image quality. The tantalate phosphors described above along with phosphors such as gadolinium oxysulfide, are useful with these silver halide elements. However, there is a continuing requirement to improve the speed and sharpness of these tabular grain/phosphor systems.

It is an object of this invention to provide a mixed phosphor X-ray intensifying screen that will produce high speed and higher resolution than that of the individual phosphor components when exposed to X-rays using either tabular or conventional, e.g., spherical or semi-spheroidal, grain silver halide elements.

SUMMARY OF THE INVENTION

In accordance with this invention there is provided an X-ray intensifying screen comprising a support, a layer of a phosphor mixture dispersed in a binder on said support, the improvement wherein said phosphor mixture consists essentially of a rare earth tantalate having the monoclinic M′ structure, said tantalate being $YNb_xTa_{1-x}O_4$, where x is 0 to about 0.15, to which is added 10% to 80% by weight based on the total weight of the phosphor mixture of a rare earth activated lanthanum oxyhalide.

DETAILED DESCRIPTION OF THE INVENTION

Screens made from the mixture set out above will do more than exhibit the high conversion efficiency of the oxyhalide component and the excellent image quality of the tantalate component. These screens show a higher resolution than can be predicted from a knowledge of the individual components alone. While this effect is particularly noted with tabular grain silver halide elements, it also occurs when conventional silver halide photographic elements are used.

Preferably, the lanthanum oxyhalide will be an activated LaOBr and will be present in the broad range of 10 to 80% by weight and more preferably in the range of 15 to 35% by weight and still more preferably in the range of 20 to 30% by weight. The composite, preferred structure of X-ray intensifying screen contains, in order, a support, which may contain reflective or absorptive particles dispersed therein or an optional reflective or absorbing layer coated thereon, a fluorescent layer containing the mixed phosphors of this invention, and a protective layer. This structure is eminently useful as an X-ray conversion screen for used with tabular grain, blue sensitive gelatino silver halide elements because it will produce excellent resolution and speeds at lower X-ray exposure ranges. Additionally, conventional methods of speed and image quality control such as through the addition of dyes, light absorbers and brighteners may be employed to further enhance the image quality obtained from the X-ray intensifying screens of this invention.

The activated lanthanum oxyhalide, e.g., thulium, etc., and niobium activated yttrium tantalate phosphors are made by methods well-described in Brines and Rabatin U.S. Pat. No. 4,499,159 and Brixner U.S. Pat. No. 4,225,653, respectively, the disclosures of which are incorporated herein by reference. X-ray intensifying screens are then made by mixing the two phosphors in the desired ratio and combining this mixture in a solvent, e.g., a mixture of n-butyl acetate and n-propanol, with a suitable binder, e.g., polyvinyl butyral or an acrylic binder, e.g., carboxylated methyl methacrylate, using conventional dispersion techniques. Useful acrylic binders include: Carboset ® Acrylic resins manufactured by B. F. Goodrich, Cleveland, OH, e.g., Carboset ® 525, ave. mol. wt. 260,000, acid no. 76–85; Carboset ® 526, ave. mol. wt. 200,000, acid no. 100;

Carboset ® XL-27, ave. mol. wt. 30,000, acid no. 8, etc. This phosphor/binder mixture may then be coated on a support which may have a reflective layer already coated thereon, e.g., a layer of $TiO_2$ dispersed in a binder. Alternatively, the base support itself, e.g., polyethylene terephthalate, or other suitable film support, may have small amounts of a reflective pigment dispersed within the base structure itself. Also, the phosphor/binder mixture may be coated on a support containing or having coated thereon, a light absorbing pigment such as carbon black for use in radiographic procedures where even higher resolution is desired and higher radiation exposure can be tolerated. After coating the phosphor/binder layer on the support, it is also conventional to apply a .protective topcoat supra thereto. This topcoat serves to protect the valuable phosphor layer from stains and handling artifacts that may occur during use and thus prolongs the life of the X-ray intensifying screen element. Conventional supports, binders, mixing and coating processes for the manufacture of typical X-ray screens are, for example, described in the aforementioned Patten patent, the disclosures of which are incorporated herein by reference.

The X-ray photographic elements useful within the ambit of this invention include known conventional, e.g., spherical, grained silver halide elements, e.g., Cronex ® Medical X-ray film, E. I. du Pont de Nemours and Co., and preferably tabular grain silver halide elements which are well-known in the prior art. Nottorf U.S. Pat. No. 4,722,886 and Ellis U.S. Pat. No. 4,801,522, for example, describe methods for preparation of tabular grain silver halide elements. Tabular chloride emulsions are described in Maskasky U.S. Pat. No. 4,400,463 and Wey U.S. Pat. No. 4,399,205. Additional U.S. Pat. Nos. which describe the manufacture and use of tabular grain elements are Dickerson, 4,414,304, Wilgus et al., 4,434,226, Kofron et al., 4,439,520 and Tufano et al., 4,804,621. The disclosures of the above U.S. patents are incorporated herein by reference. The tabular grains usually are silver halide grains wherein at least 50% of said grains are tabular silver halide grains with a thickness of less than 0.5 μm and a average aspect ratio of greater than 2:1. These grains are generally made into an emulsion using a binder such as gelatin, and are then sensitized with gold and sulfur salts, for example. Other adjuvants such as antifoggants, wetting and coating aides, dyes, hardeners, etc., may also be present if necessary. The emulsion is usually double-side coated onto a support, e.g., dimensionally stable polyethylene terephthalate, and a thin, hardened gelatin overcoat is usually applied over each of the emulsion layers to provide protection thereto. Since these emulsions are generally UV sensitive in and of themselves, it may not be required to add any kind of sensitizing dye thereto. However, if required, a small amount of a sensitizing dye might advantageously be added. It is conventional to add such a sensitizing dye to an all tabular grain emulsion in order to increase there ability to respond to light. These tabular silver halide elements have a considerable advantage since they are more sensitive and can be coated at thinner coating weights without substantial loss in covering power. Additionally, these emulsions can be forehardened with small amounts of conventional hardeners.

In a particularly preferred embodiment of an X-ray intensifying screen/photographic film combination, a pair of X-ray intensifying screens is made using a mixture of about 80% by weight of LaOBr:TM and about 20% of $YTa_{0.995}Nb_{0.005}O_4$ dispersed in a mixture of a carboxylated methyl methacrylate acrylic resin and a solvent mixture of n-propanol and n-butyl acetate, which is coated on a polyethylene terephthalate film support containing a small amount of anatase $TiO_2$ whitener dispersed therein, e.g., to provide a $TiO_2$ coating weight of about 5 mg/cm$^2$ The phosphor may be coated to a coating weight of ca. 15 to 110 mg of phosphor per cm$^2$. A topcoat of styrene/acrylonitrile copolymer is coated thereon and dried. A preferred dry thickness is about 10 μm. The photographic film element is a double-side coated, gelatino silver bromoiodide element containing tabular grains with a thickness of about 0.25 μm and an average aspect ratio of about 4.5:1. One screen is placed facing each of these silver halide layers which are applied on either side of a dimensionally stable, polyethylene terephthalate support and overcoated with a gelatin antiabrasion layer.

In the practice of this invention, the double-side coated, gelatino silver halide element is placed in a conventional cassette between a pair of the X-ray intensifying screens as described above. This element is then place in proximity to the object which is to be examined, e.g., a human patient. X-rays are generated from a source, pass through the object, and are absorbed by the intensifying screens. UV/visible light given off as a result of this X-ray absorption, exposes the film element contained therein. A high quality image with high resolution can thus be obtained.

EXAMPLES

This invention is illustrated but not limited by the following specific controls and examples wherein the percentages are by weight.

CONTROL 1

An X-ray intensifying screen was made by ball milling 100 gm of $YTa_{0.995}Nb_{0.005}O_4$ in 6 gm of a carboxylated methyl methacrylate acrylic binder with 1 gm of a mixture of a block copolymer of polyoxyethylene and polypropylene glycol, a plasticizer, and dioctyl sodium sulfosuccinate, wetting agent using a solvent mixture of a 1 to 1 weight mixture of n-butyl acetate and n-propanol. This suspension was cast on a 0.010 inch (0.25 mm) polyethylene terephthalate support to a coating weight of about 58 mg/cm$^2$. This film support had an amount of $TiO_2$ dispersed therein as described above to provide a $TiO_2$ coating weight of about 5 mg/cm$^2$. The topcoat layer coated on the phosphor layer consisted of a styrene/acrylonitrile block copolymer to provide a dry coating thickness of about 10 μm. A test exposure was made through a test target using a standard, tabular grain silver bromoiodide element having a thickness of about 0.25 μm and an average aspect ratio of about 4.5:1 at 70 kVp and 5 mas at a film to X-ray tube distance of 130 cm. After this exposure, the film was developed, fixed and dried in a conventional manner. This exposure dosage was given a value of 1.00. The image produced had a resolution of 1.00.

CONTROL 2

An X-ray intensifying screen was made by ball milling 100 gm of LaOBr:Tm in 8 gm of the acrylic binder described in Control 1 using the same solvent mixture. This suspension was cast on the film support described in Control 1 to a coating weight of about 58 mg/cm$^2$ and the topcoat described in Control 1 was applied thereto and dried. A sample of the same film described in Control 1 was placed in contact with this screen and given an exposure to the same device. When this combination was given approximately 56% of the dose of the system of Control 1, the resolution measured on the film was 0.95. This Control demonstrates that X-ray screens using LaOBr phosphors have higher efficiency that those containing $YTaO_4$ but produce poorer image quality at equal phosphor coating weight.

EXAMPLE 1

An X-ray intensifying screen was prepared by mixing 90% of the phosphor described in Control 1 with 10% of the phosphor described in Control 2 and dispersing 100 gm of this mixture in 6.25 gm of the acrylic binder in the solvent mixture as described in Control 1. The mixture was cast on the same support described in Control 1 to achieve a phosphor coating weight of about 58 mg/cm$^2$ and with the topcoat described in Control 1 placed supra thereto. After drying, this screen was given an exposure as described in Control 1 using the same film described therein. Results show that the resolution was 1.14 times higher than either Control 1 or 2 at 90% of the exposure level of Control 1. Thus, a patient could receive considerably less exposure to harmful X-rays and yet the resulting image would have superior results.

EXAMPLE 2

Example 1 was repeated except that 80% of the phosphor described in Control 1 and 20% of the phosphor described in Control 2 were used. Results showed that the resolution obtainable was 1.07 at 79% of the exposure level.

EXAMPLE 3

X-ray intensifying screens were prepared as described in Example 2 except that 15% of the phosphor weight was thulium activated lanthanum oxybromide and 85% niobium activated yttrium tantalate. The screens were made from a phosphor dispersion consisting of 2000 gm mixed phosphors and 125 gm of acrylic polymer in the solvent mixture described in Control 1. The phosphor/binder mixture was coated on the same substrate as described in Control 1, dried and overcoated with a protective layer also as described in Control 1. The screens were coated to achieve an asymmetric disposition of coating weight such that one screen had a lower coating weight than the other to achieve equal exposure of both emulsions of the double-coated silver halide element. When a screen with a coating weight of 64 mg/cm2 was combined with a screen coated at 111 mg/cm$^2$ in such a manner that the screen with the lower coating weight was used to expose the silver halide emulsion nearest the exposure source and the higher coating weight screen the emulsion layer distal to the source, it was found that the system gave performance superior to commercially available Cronex ®\Quanta III X-ray intensifying screens (E. I. du Pont de Nemours and Company, Wilmington, DE). The resolution of the screens of this invention was equal to that of the commercial screens with 20% less radiographic mottle or noise when the silver halide element used tabular grains. When the silver halide element was made from conventional grains, Cronex® 7 High Speed Medical X-Ray Film, E. I. du Pont de Nemours and Company, Wilmington, DE, and used with the screens of this invention, resolution was 1.05 times greater while radiographic mottle was 14% lower than said commercial screen.

What is claimed is:

1. An X-ray intensifying screen comprising a support, a layer of a phosphor mixture dispersed in a binder on said support, the improvement wherein said phosphor mixture consists essentially of a rare earth tantalate having the monoclinic M' structure, said tantalate being $YNb_xTa_{1-x}O_4$, where x is 0 to about 0.15, to which is added 10% to 80% by weight based on the total weight of the phosphor mixture of a rare earth activated lanthanum oxyhalide.

2. A screen according to claim 1 wherein the rare earth activated lanthanum oxyhalide is thulium activated lanthanum oxybromide.

3. A screen according to claim 1 wherein the thulium activated lanthanum oxyhalide is present in a range of 15 to 35% by weight.

4. A screen according to claim 2 wherein the thulium activated lanthanum oxybromide is present in a range of 15 to 35% by weight.

5. A screen according to claim 1 wherein the side having the phosphor layer is placed facing a silver halide photographic film element and is exposed to X-ray radiation.

6. A screen according to claim 5 wherein the silver halide film element contains at least 50% by weight tabular silver halide grains.

7. A screen according to claim 6 wherein the tabular grains having a thickness of less than 0.5 μm and an average aspect ratio of greater than 2:1.

8. An X-ray intensifying screen comprising a support, a layer of a phosphor mixture dispersed in a binder on said support, the phosphor mixture consisting essentially of 15 to 35% by weight thulium activated lanthanum oxybromide and 65 to 85% by weight of niobium activated yttrium tantalate having the monoclinic M' structure coated at a coating weight of 15 to 110 mg of phosphor per cm$^2$; and a topcoat layer of a polymeric binder.

9. A screen according to claim 8 wherein the binder for the layer of phosphor mixture is a carboxylated methyl methacrylate.

10. A screen according to claim 8 wherein the polymeric binder of the topcoat layer is a styrene/acrylonitrile block copolymer.

11. A pair of X-ray intensifying screens, each screen comprising a support, a layer of a phosphor mixture dispersed in a binder on said support, the phosphor mixture dispersed in a binder on said support, the phosphor mixture consisting essentially of 15–35% by weight thulium activated lanthanum oxybromide and 65 to 85% by weight of niobium activated yttrium tantalate having the monoclinic M'structure coated at a coating weight of 15 to 110 mg of phosphor per cm2; and a topcoat layer of a polymeric binder, wherein the phosphor layer of each screen is placed facing a silver halide emulsion layer of a double-side coated, gelatino silver halide element present between the screen pair, the coating weight of the phosphor layers being asymmetrically distributed to give equal exposure to each of said silver halide emulsion layers.

12. A pair of X-ray intensifying screens according to claim 11 wherein the silver halide element contains at least 50% by weight tabular silver halide grains.

* * * * *